United States Patent [19]

Radtke

[11] Patent Number: 4,640,854

[45] Date of Patent: Feb. 3, 1987

[54] SELF-SUPPORTING COMPOSITE PLATE, ESPECIALLY FOR DOUBLE FLOORS

[75] Inventor: Manfred Radtke, Margetshöchheim, Fed. Rep. of Germany

[73] Assignee: MERO-Werke Dr.-Ing Max Mengeringhausen GmbH & Co., Wurzburg, Fed. Rep. of Germany

[21] Appl. No.: 767,716

[22] Filed: Aug. 20, 1985

[30] Foreign Application Priority Data

Aug. 24, 1984 [DE] Fed. Rep. of Germany ..... 3431118

[51] Int. Cl.[4] ..... B32B 3/12

[52] U.S. Cl. ..... 428/35; 428/70; 428/138; 428/166; 428/179; 428/703; 52/596; 52/601; 52/792

[58] Field of Search ..... 428/35, 70, 138, 166, 428/179, 703; 52/596, 601, 602, 792

[56] References Cited

U.S. PATENT DOCUMENTS 3,286,418 11/1966 Radford ..... 52/223
3,845,593 11/1974 Zen ..... 52/144
4,411,121 10/1983 Blackin et al. ..... 52/792
4,596,730 6/1986 Klingelhofer ..... 428/73

FOREIGN PATENT DOCUMENTS 2930426 7/1979 Fed. Rep. of Germany .
2143610 9/1973 France .
544042 3/1942 United Kingdom .
1338449 11/1973 United Kingdom .
2050904 1/1981 United Kingdom .

*Primary Examiner*—John E. Kittle
*Assistant Examiner*—Patrick J. Ryan
*Attorney, Agent, or Firm*—Quaintance, Murphy & Presta

[57] ABSTRACT

A self-supporting composite plate for double floors or the like, comprising a pan-shaped wrapper for receiving therein a flowable and hardenable filler material of high compression resistance when in a hardened state, such as anhydrite or concrete. The pan-shaped wrapper comprises a plurality of downwardly extending burl-like projecting blocks containing the filler material. A base element of high tensile strength is connected to the projecting blocks.

10 Claims, 4 Drawing Figures

FIG. 1
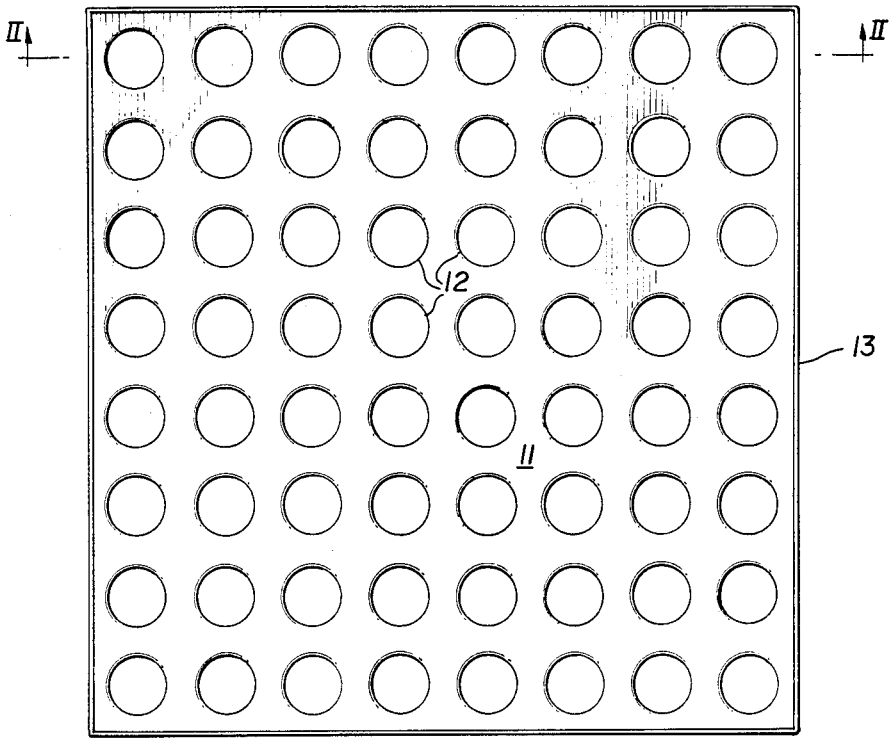
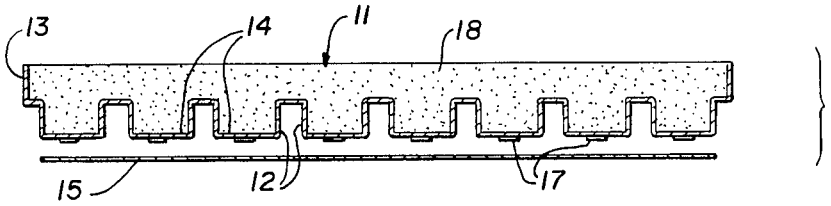
FIG. 2

SELF-SUPPORTING COMPOSITE PLATE, ESPECIALLY FOR DOUBLE FLOORS

BACKGROUND OF THE INVENTION

The invention relates to a self-supporting composite plate, especially for double floors, with a pan-shaped outside wrapping to hold filler material which is flowable or feedable and hardenable, with high compression resistance when hardened, e.g. anhydrite, concrete or the like.

A self-supporting composite plate of this type is known from German Patent No. 2,004,101. The pan-shaped wrapping of this composite plate has a practically planar bottom and its total unobstructed section is filled with anhydrite or the like, so that the composite plate is correspondingly heavy. In many cases, however, a lightweight plate is preferred, but without loss of the numerous advantages of this composite plate, e.g. the great fire-resistance, carrying capacity, impact sound insulation and so forth.

Double floor plates are also already known from German Patent Nos. 3,103,632 and 2,930,426, which have numerous burl-like projections on their bottoms, which however are totally supported on a foundation, and a plurality of supports are thus formed. These double floor plates may be lighter than the aforementioned composite plates, but they are not self-supporting, i.e. cannot be supported exclusively at their corners on footrests, because the wrapping required for this is not present.

U.S. Pat. No. 4,411,121 discloses a double floor plate of steel, which includes a planar cover plate, welded onto the apexes of a plurality of cupola-shaped projections as well as onto the surrounding, upward-curved edges of a bottom part. This double floor plate is also relatively heavy, but its main drawback is that, if a fire breaks out in the hollow space of the double floor, there is practically unhindered heat transmission in the space found over it with all of the inherent disadvantageous results, because of the metal connection of the bottom with the top of the plate.

SUMMARY OF THE INVENTION

The object of the invention is to construct a self-supporting composite plate of improved structure, so that it is remarkably lightweight and its advantageous properties described above are nonetheless retained.

In the present invention, the pan-shaped wrapper is provided with a plurality of burl-like projecting blocks, containing filler material, which are connected with each other by a base element of high tensile strength. If one assumes the same structural height of the known composite plate as the composite plate according to the invention, then a remarkably lower quantity of filler is incorporated by the burl-like projecting blocks on the bottom of the pan-shaped wrapper of the invention than by the corresponding bottom unobstructed sectional area of the known pan-shaped wrapper with a practically planar bottom. The weight reduction thus produced with the finished composite plate in comparison with the state of the art is approximately 40%. From a static point of view, the smaller quantity of filler in the bottom sectional area of the composite plate (beneath the middle plate plane) is irrelevant, since only tensile stresses occur in this area henceforth with loading of the composite plate, and very low tensile strength and very low elasticity module are required. The high carrying capacity of the composite plate according to the present invention is assured in that a base element of high tensile strength is mounted on the burl-like projecting blocks which are projecting downwardly and which absorb the traction or tension on the bottom.

Because of the arrangement of such a base element, it is also possible to use relatively thin material for the pan-shaped wrapper, which favorably effects its manufacturing cost. A sufficient quantity of filler for the impact sound insulation is also in the composite plate according to the present invention. The relatively high fire-resistance of the composite plate is assured by use of a sufficiently thick filler layer for this purpose, over the total plate section between the pan-shaped wrapper and the plate surface. Any desired floor covering of course can be mounted on the plate. The burl-like projecting blocks on the bottom of the pan-shaped wrapper are preferably of uniform configuration and are arranged in a uniform arrangement and manufactured most appropriately by deep-drawing, using sheet steel for the pan-shaped wrapper. The base element of higher tensile strength can be welded, glued, riveted or even screwed onto the burl-like projecting blocks.

As an illustrative example, the base element can consist simply of a thin sheet metal plate. For further weight reduction of the composite plate, the base element can be perforated.

The flex-resistance of the composite plate is improved if the base element is provided with reinforcement in the form of stiffening corrugations or the like. According to another configuration of the invention, the base element may also be configured as a grid, e.g. a structural steel grid.

The burl-like projecting blocks can be approximately half the total height of the pan-shaped wrapper and thus can be below the middle plane of the composite plate. Also, the burl-like projecting blocks can be configured as truncated cones, with smaller diameters to the outside. Truncated cones as burl-like projecting blocks are preferred for simplified removal of the finished pan-shaped wrapper from the deep-drawing tool.

According to still another configuration of the invention, if the burl-like projecting blocks, because they taper somewhat, arch slightly upwardly at the middle of the pan-shaped wrapper, so that following subsequent introduction of the filler material, the bottom and top of the composite plate are substantially parallel to each other, the slight flexing of the pan-shaped wrapper caused by the weight of the filler material is advantageously compensated.

In a composite plate of which the pan-shaped wrapper has openings with inward pressed edges for anchoring in the filler material, it is appropriate for reasons of production that the bottoms of the burl-like projecting blocks incorporate these openings.

According to still another configuration of the invention, when the openings in the bottoms of the burl-like projecting blocks are closed from the outside by the base element, the filler material cannot penetrate through these openings insofar as it is still found in flowable or feedable state. The plugging materials introduced through the openings until this time for the same purpose are thus advantageously replaced by the base element.

The point welding process is simplified if the burl-like projecting blocks are provided with weld projections on their bottoms for alignment of the base element.

BRIEF DESCRIPTION OF THE DRAWING

The present invention is explained hereinafter relative to the drawings of exemplary embodiments.

FIG. 1 is a top plan view of a pan-shaped wrapper for a self-supporting composite plate according to the present invention;

FIG. 2 is a partial sectional view taken substantially along line II—II of FIG. 1, with a sheet metal plate as the base element before its connection with the pan-shaped wrapper by point welding, the wrapper being filled with filler material;

DESCRIPTION OF THE PREFERRED EMBODIMENTS

Figure 3:
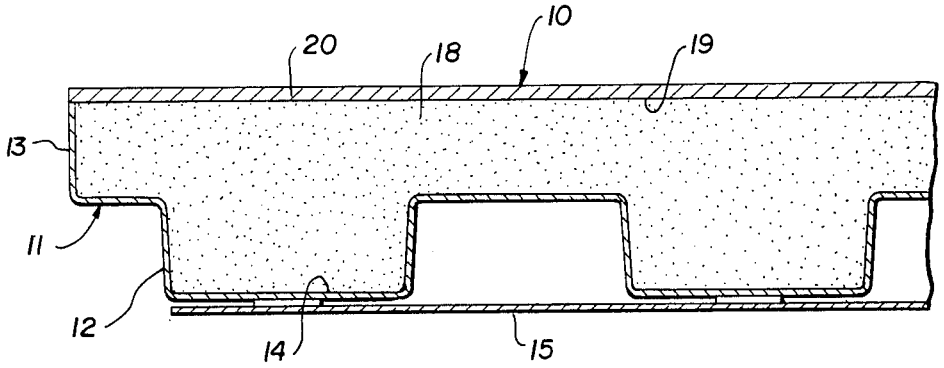
FIG. 3 is an enlarged partial side elevational view in section of a finished self-supporting composite plate, which includes the pan-shaped wrapper of FIGS. 1 and 2 as well as a welded-on base element.
Figure 4:
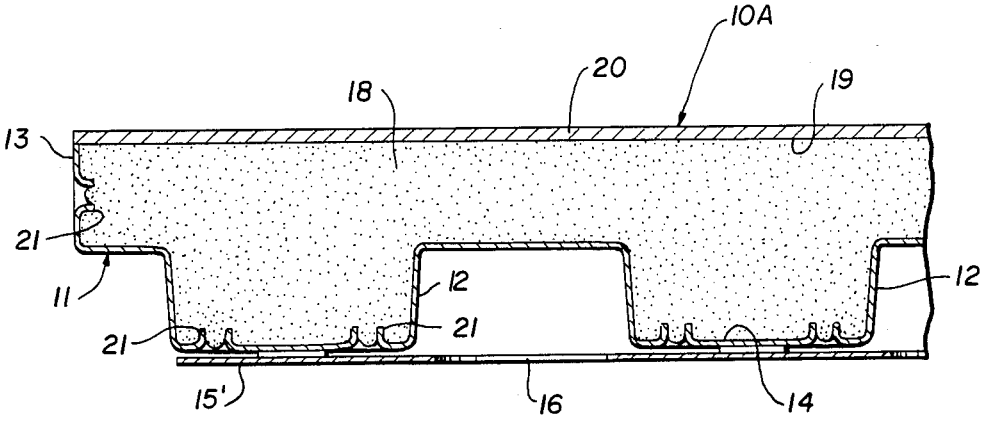
FIG. 4 is a partial side elevational view in section similar to that of FIG. 3, showing a finished self-supporting composite plate with different embodiments of the pan-shaped wrapper and the base element.

The self-supporting composite plates 10 and 10A shown as exemplary embodiments in FIGS. 3 and 4, respectively, form base plates for double floors. Such base plates are laid out with their edges tightly joined and are supported at their corners on footrests or the like, which in turn are mounted in the foundation of the building.

Composite plate 10 includes a pan-shaped outside wrapper 11, which in a preferred embodiment is formed of sheet steel with a surface protection, e.g., a zinc coating. The pan-shaped wrapper 11 has a plurality of uniformly arranged burl-like projecting blocks 12 on its bottom, which preferably are formed together with the upwardly projecting, surrounding side walls 13 thereof in a deep-drawing process. These burl-like projecting blocks 12 are in the form of truncated cones which taper slightly inwardly and downwardly. The height of projecting blocks 12 corresponds approximately to half the height of wrapper 11, and the height of the burl-like projecting blocks 12 at the middle of the pan-shaped wrapper 11 can be tapered progressively so that the bottoms 14 of projecting blocks 12 are curved slightly upwardly toward the middle of the wrapper. This adds the advantage that, during the hereinafter described introduction of filler material into the pan-shaped wrapper, as a result of the weight of the filler material, pan-shaped wrapper 11 is deformed downwardly in the middle to such an extent that the bottom and top of the finished composite plate 10 run substantially parallel to each other. With, e.g., 600 mm edge length of finished composite plate 10, the burl-like projecting blocks 12 could have a smallest diameter of 20 mm and could be arranged with a mutual spacing of 40 mm, measured from midpoint to midpoint of the projecting blocks.

On the smooth bottom 14 of each burl-like projecting block 12, there is point-welded a thin sheet metal plate serving as base element 15, which can be provided with openings 16 between projecting blocks 12 and opposite the hollow spaces, to further save weight, as is shown in FIG. 4. FIG. 2 shows that, on the outside in the middle of the projecting block bottoms 14 are arranged weld projections 17, which simplify the alignment of base element 15 for use of a suitable point welding machine. When finished composite plate 10 is loaded, the base element 15 serves to absorb tensile stresses and preferably is provided with a surface protection, e.g., a zinc coating, similar to pan-shaped wrapper 11.

For completion of the self-supporting composite plate 10, a flowable or feedable and hardenable filler material 18, preferably anhydrite, is introduced into pan-shaped wrapper 11 which is open at the top. After it passes through a vibration station, excess filler material 18 is stripped or peeled off, in order to attain a smooth upper surface 19, as shown in FIGS. 3 and 4. Surface 10 can be abraded following subsequent hardening of filler material 18, so that it is henceforth planar. A flooring 20 is then mounted on surface 19, e.g., a carpet, a plastic plate or the like, adhesively mounted.

The self-supporting composite plate 10A shown partially in FIG. 4 essentially corresponds to that of FIG. 3 and the same parts thus have the same identification numbers. As opposed to the embodiment of FIG. 3, however, pan-shaped wrapper 11 on its surrounding side walls 13 as well as on the bottoms 14 of its burl-like projecting blocks 12 is provided with openings 21 with inwardly-drawn edges, which serve to combine or interlock pan-shaped wrapper 11 with filler material 18. The filler material which is forced into the openings 21, following its hardening, forms substantially conical anchoring members. The corresponding individual features are disclosed in detail in German Patent No. 2,004,202.

The thin sheet steel fastened by point welding onto the bottoms 14 of projecting blocks 12, and serving as base element 15', serves not only to absorb traction stresses with loading of composite plate 10A, but also, during the filling process, serves to prevent discharge of filler material 18 from openings 21 in the bottoms 14 of the projecting blocks 12. Openings 21 in the side walls 13 of pan-shaped wrapper 11 for the same reason are closed on the outside with an adhesive strip (not shown) or the like. As previously described, the sheet metal plate serving as base element 15' in the embodiment of FIG. 4 has openings 16 between the projecting blocks 12 for weight reduction.

Within the scope of the present invention the burl-like projecting blocks 12 in pan-shaped wrapper 11 could also be configured as cylinders or polygons. Although zinc-coated sheet steel is preferred for the pan-shaped wrapper 11 and base element 15 and 15', these structural parts could be formed of other suitable materials.

I claim:

1. Self-supporting composite plate, for double floors or the like, with a pan-shaped outside wrapper for flowable and hardenable filler material with high compression resistance when in hardened state, e.g. anhydrite, concrete or the like, characterized in that the pan-shaped wrapper (11) is provided on the bottom thereof with a plurality of burl-like projecting blocks (12) containing filler material (18), and a base element (15) of high tensile strength is connected to said projecting blocks, said base element (15) being a thin sheet metal plate and being welded to the bottoms of the projecting blocks (12) to absorb tensile stresses thereon.

2. Composite plate as in claim 1, characterized in that the base element (15) is perforated.

3. Composite plate as in claim 1, characterized in that the base element (15) is provide with stiffening means.

4. Composite plate as in claim 1, characterized in that the burl-like projecting blocks are approximately half the total height of the pan-shaped wrapper (11).

5. Composite plate as in claim 1, characterized in that the burl-like projecting blocks (12) are configured as truncated cones that taper inwardly and downwardly.

6. Composite plate as in claim 1, characterized in that the height of the burl-like projecting blocks (12) is tapered progressively upwardly toward the middle of the pan-shaped wrapper (11), in order to arch the bottom of the pan-shaped wrapper (11) upwardly toward the middle thereof, whereby following subsequent introduction of the filler material (18), the bottom of the wrapper (11) is deformed downwardly at the middle thereof so that the bottom and top of the composite plate (10, 10A) run substantially parallel to each other.

7. Composite plate as in claim 1, wherein the pan-shaped wrapper (11) has openings (21) therein with inwardly pressed edges for anchoring in the filler material.

8. Composite plate as in claim 9, wherein the openings (21) are in the bottoms (14) of the burl-like projecting blocks (12).

9. Composite plate as in claim 10, characterized in that the openings (21) in the bottoms (14) of the burl-like projecting blocks (12) are closed from the outside by the base element (15).

10. Composite plate as in claim 2, characterized in that the burl-like projecting blocks (12) are provided on their bottoms with weld projections (17) for the alignment of the base element (15).

* * * * *